US010112747B2

(12) United States Patent
Lee

(10) Patent No.: US 10,112,747 B2
(45) Date of Patent: Oct. 30, 2018

(54) FOAM GENERATOR FOR COMPRESSION RECEPTACLES

(71) Applicant: APOLLO INDUSTRIAL CO., LTD., Siheung-si, Gyeonggi-do (KR)

(72) Inventor: Jae Kyung Lee, Seoul (KR)

(73) Assignee: APOLLO INDUSTRIAL CO., LTD., Siheung-si, Gyeonggi-do (KR)

( * ) Notice: Subject to any disclaimer, the term of this patent is extended or adjusted under 35 U.S.C. 154(b) by 0 days.

(21) Appl. No.: 15/746,851

(22) PCT Filed: Oct. 4, 2016

(86) PCT No.: PCT/KR2016/011086
§ 371 (c)(1),
(2) Date: Jan. 23, 2018

(87) PCT Pub. No.: WO2017/065441
PCT Pub. Date: Apr. 20, 2017

(65) Prior Publication Data

US 2018/0208368 A1 Jul. 26, 2018

(30) Foreign Application Priority Data

Oct. 13, 2015 (KR) ..... 10-2015-0142546

(51) Int. Cl.
*B65D 47/20* (2006.01)
*A61H 7/00* (2006.01)
(Continued)

(52) U.S. Cl.
CPC ..... *B65D 47/2012* (2013.01); *A61H 7/00* (2013.01); *A61H 7/005* (2013.01); *B65D 47/00* (2013.01);
(Continued)

(58) Field of Classification Search
CPC ..... B65D 47/2012; B65D 47/00; A61H 7/00; A61H 7/005
(Continued)

(56) References Cited

U.S. PATENT DOCUMENTS 4,883,204 A * 11/1989 Kay ..... A45D 34/042 222/192
5,813,571 A * 9/1998 Gaucher ..... B05B 11/0043 222/105
(Continued)

FOREIGN PATENT DOCUMENTS

JP 2014-046943 A 3/2014
JP 2014-105030 A 6/2014
(Continued)

*Primary Examiner* — Vishal Pancholi
(74) *Attorney, Agent, or Firm* — Novick, Kim & Lee, PLLC; Jae Youn Kim

(57) ABSTRACT

A foam generator for compression receptacles is configured such that liquid contents pumped by an internal pressure as a result of directly compressing a compression receptacle, having the liquid contents stored therein, are mixed with air in a gas-liquid mixing chamber and, at the same time, directly discharged in the form of foam. Accordingly, the foam generator not only is capable of preventing the corruption of the liquid contents, which are not in contact with any separate metal member, but also further improves product responsiveness, since the contents are instantly discharged in the form of foam by compressing the compression receptacle.

3 Claims, 8 Drawing Sheets

(51) Int. Cl.

| | |
|---|---|
| ***B65D 47/00*** | (2006.01) |
| ***B65D 47/32*** | (2006.01) |
| ***B65D 51/16*** | (2006.01) |
| ***B65D 51/24*** | (2006.01) |
| ***B65D 85/73*** | (2006.01) |
| *B65D 47/14* | (2006.01) |

(52) U.S. Cl.
CPC ..... *B65D 47/20* (2013.01); *B65D 47/32* (2013.01); *B65D 51/16* (2013.01); *B65D 51/1655* (2013.01); *B65D 51/24* (2013.01); *B65D 85/73* (2013.01); *B65D 47/14* (2013.01)

(58) Field of Classification Search
USPC ..... 222/189.06, 189.08, 189.11, 190, 321.1, 222/330, 478, 481.5, 485, 492, 631
See application file for complete search history.

(56) References Cited

U.S. PATENT DOCUMENTS 8,678,241 B2 * 3/2014 Wang ..... B05B 7/0037 222/190
9,004,318 B2 * 4/2015 Kodama ..... B05B 7/0037 222/145.5
9,004,319 B2 * 4/2015 Kim ..... B05B 11/3087 222/190
2008/0125682 A1 * 5/2008 Bonneyrat ..... A61H 7/00 601/112
2008/0273915 A1 * 11/2008 O'Connell ..... A45D 34/04 401/188 R
2010/0126523 A1 * 5/2010 Fujinuma ..... A45D 19/02 132/221
2015/0136807 A1 * 5/2015 Wang ..... A47K 5/14 222/190

FOREIGN PATENT DOCUMENTS

KR 20-0169773 Y1 2/2000
KR 10-2011-0039000 A 4/2011
KR 10-1514811 B1 4/2015
KR 10-1517825 B1 5/2015

* cited by examiner

FOAM GENERATOR FOR COMPRESSION RECEPTACLES

TECHNICAL FIELD

The present invention relates to a foam generator for compression receptacles, and more particularly to a foam generator for compression receptacles that mixes liquid contents with air and discharges the mixture in the form of foam when a compression receptacle is directly compressed.

BACKGROUND ART

In general, a foam generator mixes liquid contents stored in a receptacle with air in an air and liquid mixing chamber and then forms and discharges uniform foam liquid through a filtration net. Such a foam generator is used for various purposes, such as shampoos, hair cosmetics, or cleansers used in bathrooms, kitchens, and restrooms.

A conventional foam generator is used to mix liquid contents with an appropriate amount of air and to extrude the mixture in the form of foam. In products to which such a foam generator is applied, a receptacle must be filled with compressed gas, making it technically difficult to manufacture the receptacle. The receptacle must be shaken whenever the receptacle is used. Also, in the state in which the product receptacle is inclined, the liquid filling the receptacle cannot be ejected in the form of foam, and only the compressed gas is ejected.

In order to solve the above problem, a foaming pump assembly that appropriately mixes liquid contents with external air and ejects the mixture in the form of foam without filling the foaming pump assembly with compressed air or without shaking the foaming pump assembly is disclosed in Korean Registered Utility Model No. 20-0169773 (Title of the Device: Air valve device of foam generator).

As shown in FIG. 1, the foaming pump assembly disclosed in Korean Registered Utility Model No. 20-0169773 includes a cap 1 coupled to the neck of a receptacle A having (liquid) contents stored therein in a screw coupling manner, a cylinder body 2 fixed in the cap 1, the cylinder body 2 having an air cylinder 2a having a negative pressure hole 2b formed therein and a long cylindrical liquid cylinder 2c integrally formed at the center of the lower part of the air cylinder 2a such that the (liquid) contents are introduced into the liquid cylinder 2c, a nozzle 3 installed to the cap 1 so as to be supported by the cap 1 such that one end thereof can be movable into the cylinder body 2, the nozzle 3 having an outlet 3a, through which foam is ejected, an air piston 4 having an upper part fixed to the inner circumference of the nozzle 3 and the outer circumference of a lower end disposed in tight contact with the inner circumference of the air cylinder 2a such that the air piston 4 presses the lower part of the air cylinder 2a and expands the upper part of the air cylinder 2a when the nozzle 3 is pushed, a liquid piston 6 disposed between a coil spring 5 provided at the lower part of the liquid cylinder 2c of the cylinder body 2 and the air piston 4 for elastically supporting the nozzle 3 upward and guiding the compressed air and the contents to the upper part of the air piston 4, and a ball 8 located at the bottom part of the liquid cylinder 2c of the cylinder body 2 for selectively opening and closing a liquid suction port 7. A filtration net 9 for filtering foam is disposed in the nozzle 3.

In the conventional foaming pump assembly, when the nozzle 3 is repeatedly pushed, the (liquid) contents filling the receptacle A are suctioned/pumped through the liquid cylinder 2c. At the same time, air is ejected from the air cylinder 2a. As a result, foam is generated. The foam is uniformly filtered through the filtration net 9 and is then ejected to the outside through the outlet 3a in the nozzle 3. In the conventional foaming pump assembly, however, the coil spring 5 and the ball (steel ball) 8, which are made of metal, are disposed in the liquid cylinder 2c, which is a suction channel of the liquid contents. In the case in which the foaming pump assembly is used for a long period of time, therefore, the coil spring 5 and the ball 8 may be corroded by the liquid contents. Furthermore, the quality of the liquid contents may be changed.

Particularly, in recent years, the foaming pump assembly has come to be applied to products containing various functional contents. Since the metal coil spring 5 and the metal ball 8 remains in contact with the contents in the liquid cylinder 2c, the coil spring 5 and the ball 8 may be corroded.

DISCLOSURE

Technical Problem

The present invention has been made in view of the above problems, and it is an object of the present invention to provide a foam generator for compression receptacles configured such that liquid contents in a compression receptacle having the liquid contents stored therein are mixed with air and the mixture is discharged in the form of foam by the pressure generated in the compression receptacle when the compression receptacle is compressed, whereby it is possible to prevent a change in the quality of the contents and to improve product responsiveness.

It is another object of the present invention to provide a foam generator for compression receptacles having a discharge blocking function, whereby it is possible to more stably use the product and to prevent the leakage of liquid from the product during the distribution of the product.

It is a further object of the present invention to provide a foam generator for compression receptacles including a massage member such that a user can directly and uniformly apply the ejected foam to his/her skin without using the palms of his/her hands.

Technical Solution

In order to accomplish the above objects, the present invention provides a foam generator for compression receptacles mounted to a neck of a compression receptacle having liquid contents stored therein for mixing liquid contents, discharged out of the compression receptacle when the compression receptacle is compressed, with air and discharging the mixture in the form of foam, wherein the foam generator for compression receptacles includes: a cap main body including a large cap part fastened to the neck of the compression receptacle in a screw coupling manner, an upward and downward movement guide wall disposed at the outside of the large cap part, the upward and downward movement guide wall being formed in the shape of a cylinder, and a foam discharge part protruding from the upper part of the large cap part in the shape of a pipe having a reduced diameter while a step is formed at the lower end thereof, the upper part of the foam discharge part being open, an air hole for allowing external air to be introduced therethrough being formed in the step; a content discharge guide configured such that the edge thereof is fitted, received, and disposed in the upper end of the large cap part of the cap main body so as to be spaced apart from a lower part of the step of the cap main body, the content discharge guide including a discharge guide part having a liquid discharge port formed in a central region thereof so as to be recessed concavely and a tube coupling port provided at the center of the bottom surface of the discharge guide part, a discharge tube for discharging the liquid contents stored in the compression receptacle being coupled to the tube coupling port, the discharge guide part being provided at the edge thereof with an air discharge port, through which air in the compression receptacle can move to the upper side of the discharge guide part when the compression receptacle is compressed, and with an air introduction port, through which external air is introduced into the compression receptacle when the compression receptacle is restored to an original state thereof; a check valve unit made of an elastic material, the check valve unit including a ring-shaped partition wall, having a lower end disposed in tight contact with the upper surface of the content discharge guide and an upper end disposed in tight contact with the lower part of the step of the cap main body, for defining the air and liquid mixing chamber in the foam discharge part, a first check valve part disposed inside the partition wall so as to extend downward toward a central part thereof, an end of the first check valve part being disposed in elastically tight contact with the discharge guide part of the content discharge guide, the first check valve part being configured to selectively allow the air in the compression receptacle to move to the air and liquid mixing chamber through the air discharge port when the compression receptacle is compressed, and a second check valve part disposed outside the partition wall so as to extend upward toward an outside, an end of the second check valve part being disposed in elastically tight contact with the outside of the step of the cap main body, the second check valve part being configured to close the air hole when the compression receptacle is compressed and to open the air hole when the compression receptacle is restored to the original state thereof such that external air can be introduced; a filtration member fitted, received, and disposed in the foam discharge part of the cap main body, the filtration member being formed in the shape of a cylinder having open upper and lower parts, the filtration member being provided at the upper and lower surfaces thereof with filtration nets, the filtration member being configured to guide the discharge of foam formed as the result of the liquid contents being mixed with air in the air and liquid mixing chamber while homogenizing the foam; and an upward and downward movement cap including a cylindrical wall having a lower end received in and coupled to the upward and downward movement guide wall of the cap main body so as to be movable upward and downward and an upper surface configured to cover the upper part of the cap main body, the upper surface being provided with a plurality of foam distribution holes, through which the foam that has passed through the filtration member is discharged to the outside in a distributed manner, the upward and downward movement cap being provided at the center of the upper surface thereof with a cylindrical blocking wall for selectively opening and closing the foam discharge part according to the upward and downward manipulation thereof.

In addition, the foam generator for compression receptacles according to the present invention may further include a massage member, wherein the massage member may include: a base fitted and mounted in the upper part of the upward and downward movement cap, the base being provided therein with a plurality of communication ports, which communicate with respective foam distribution holes; and massage bristles provided at the upper surface of the base for uniformly applying the foam discharged through the communication ports to the skin of a user.

In addition, support shafts may be formed inside the upward and downward movement guide wall in a protruding manner such that the support shafts are opposite each other, and the upward and downward movement cap may be provided at the outside of the wall thereof with spiral grooves for receiving the support shafts, the spiral grooves being formed so as to be opposite each other over a predetermined region, the upward and downward movement cap being disposed so as to move upward or downward to regular positions thereof by rotating the upward and downward movement cap in a forward direction or a reverse direction, whereby, when the upward and downward movement cap is moved maximally upward as the result of the rotation of the upward and downward movement cap in the forward direction, the cylindrical blocking wall may open the foam discharge part, and when the upward and downward movement cap is moved maximally downward as the result of the rotation of the upward and downward movement cap in the reverse direction, the cylindrical blocking wall may close the foam discharge part.

Advantageous Effects

In the foam generator for compression receptacles according to the present invention having the above-stated structure, liquid contents, pumped out of the compression receptacle having the liquid contents stored therein by the pressure generated in the compression receptacle when the compression receptacle is directly compressed, are mixed with air in the air and liquid mixing chamber, and the mixture is directly discharged in the form of foam. Consequently, the liquid contents do not contact metal members, whereby it is possible to prevent a change in the quality of the liquid contents. In addition, the contents can be instantly discharged in the form of foam, whereby it is possible to improve product responsiveness. In particular, the compression receptacle can be directly compressed by a user using one hand such that the contents are discharged in the form of foam, whereby it is possible to improve user convenience.

Also, in the foam generator for compression receptacles according to the present invention, the user can apply the ejected foam to his/her skin or can cleanse his/her skin using the massage member. In particular, the user can directly and uniformly apply the ejected foam (the contents) to his/her skin using the massage member, akin to massaging the skin of the user without using the palms of the hands.

Furthermore, in the foam generator for compression receptacles according to the present invention, the upward and downward movement cap can be moved upward and downward to easily open and close the foam discharge part by manipulating the upward and downward movement cap in the forward direction and the reverse direction, whereby it is possible to more stably use the product and to prevent the leakage of liquid from the product during the distribution of the product.

DESCRIPTION OF REFERENCE SYMBOLS

Figure 1:
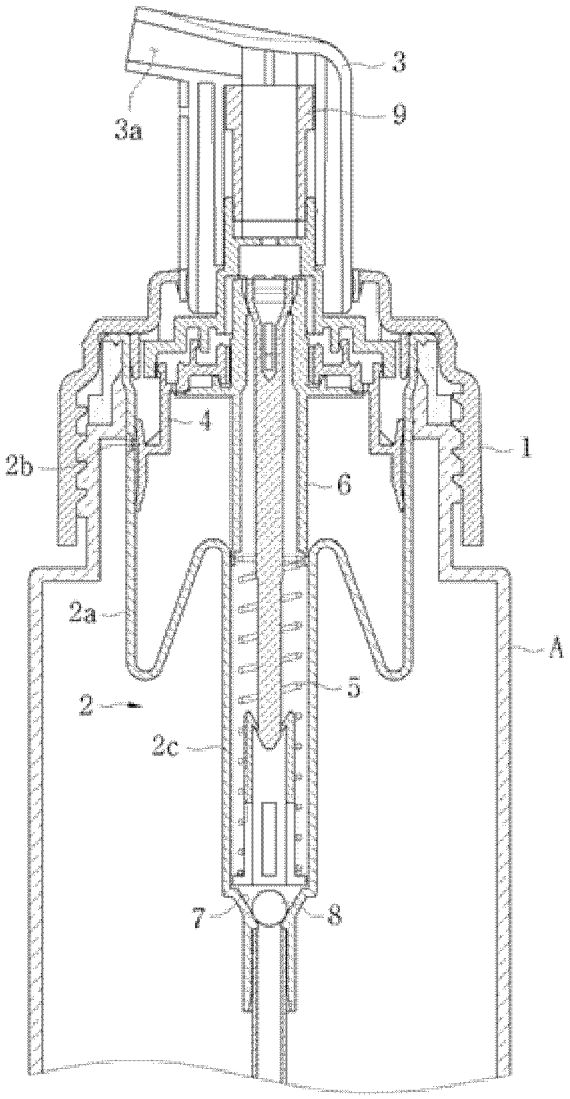
Fig. 1 PRIOR ART
FIG. 1 is a view showing an air valve device of a foam generator disclosed in Korean Registered Utility Model No. 20-0169773, which is a conventional art.

10 . . . Compression receptacle 11 . . . Neck 100 . . . Foam generator

110 . . . Cap main body 111 . . . Large cap part 112 . . . Upward and downward movement guide wall

113 . . . Step 114 . . . Foam discharge part 115: Air hole

116: Support shafts 120 . . . Content discharge guide 121 . . . Edge

122 . . . Discharge guide part 123 . . . Liquid discharge port 124 . . . Tube coupling port

125 . . . Air discharge ports 126 . . . Air introduction ports 130 . . . Discharge tube

140 . . . Check valve unit 141 . . . Partition wall 142 . . . First check valve part

143 . . . Second check valve part 150 . . . Filtration member 151 . . . Body

152, 153 . . . Filtration nets 160 . . . Upward and downward movement cap 161 . . . Wall surface

162 . . . Upper surface 163 . . . Foam distribution holes 164 . . . Blocking wall

165 . . . Spiral grooves 170 . . . Massage member 171 . . . Base

172 . . . Communication ports 173 . . . Massage bristles S . . . Air and liquid mixing chamber

BEST MODE

Figure 4:
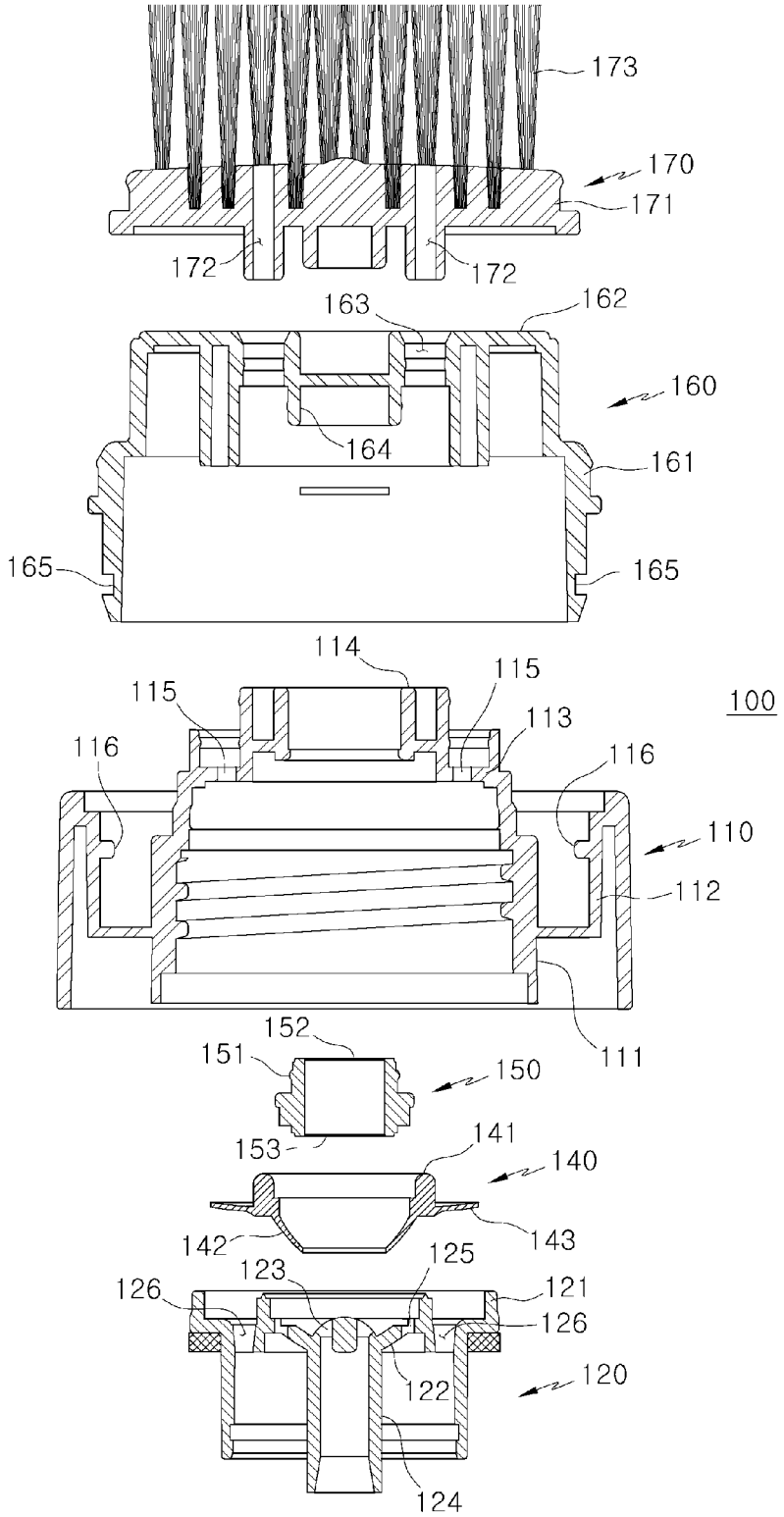
FIG. 4 is an exploded sectional view of the foam generator for compression receptacles according to the present invention.
Figure 5:
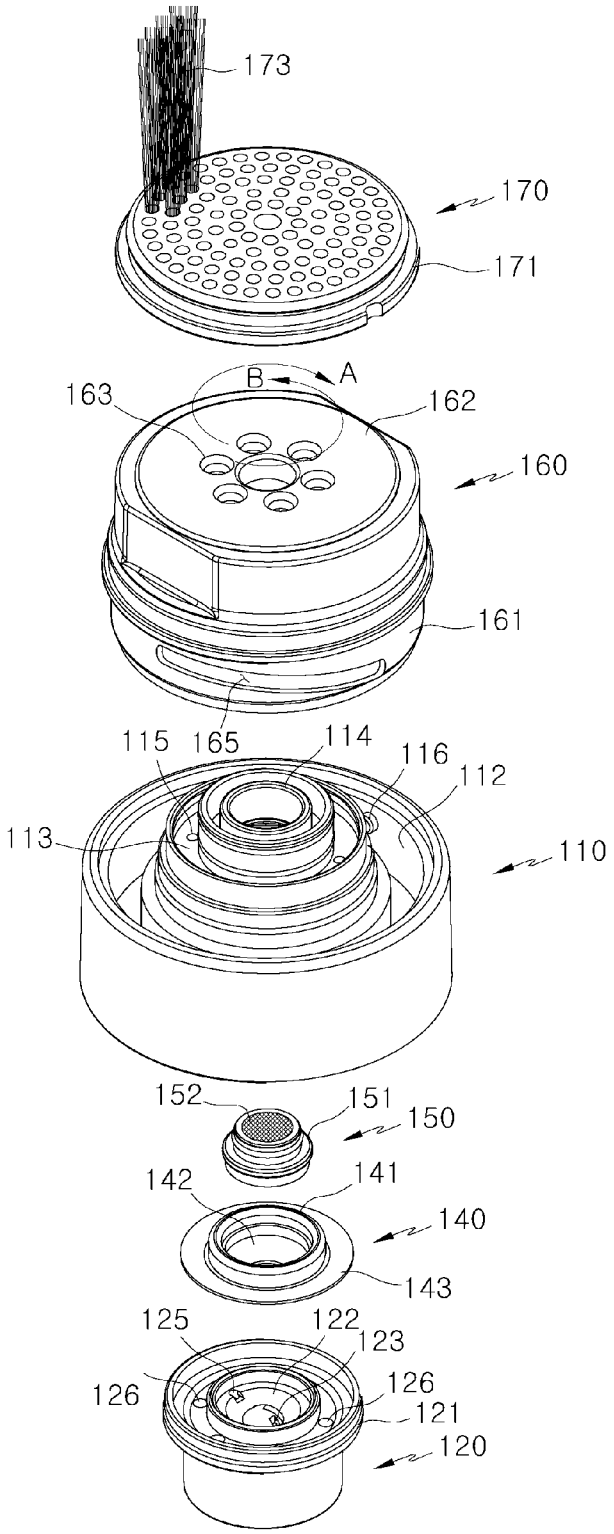
FIG. 5 is an exploded perspective view of the foam generator for compression receptacles according to the present invention.
Figure 6:
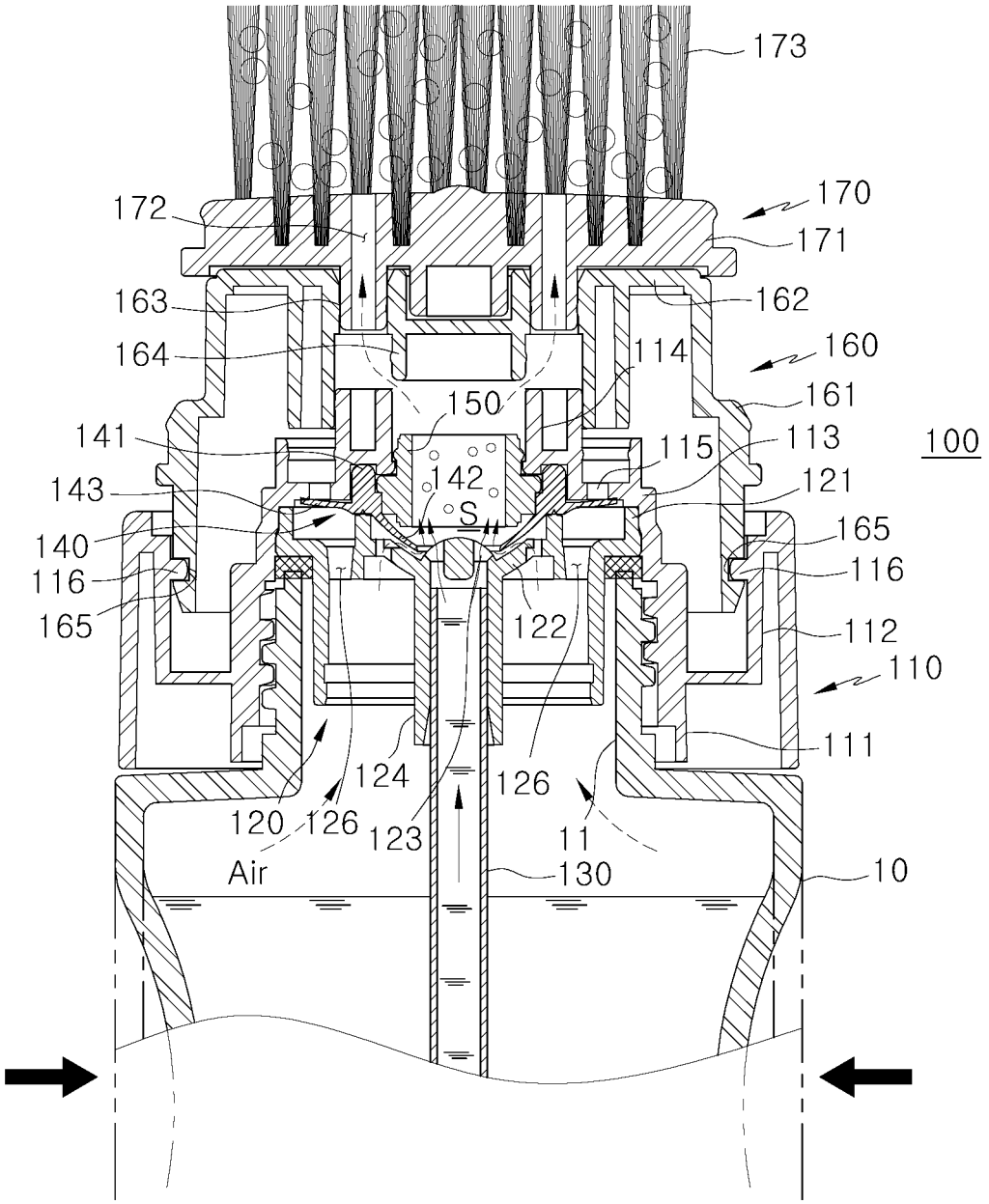
FIG. 6 is a view showing a foam ejection process of the foam generator for compression receptacles according to the present invention.
Figure 7:
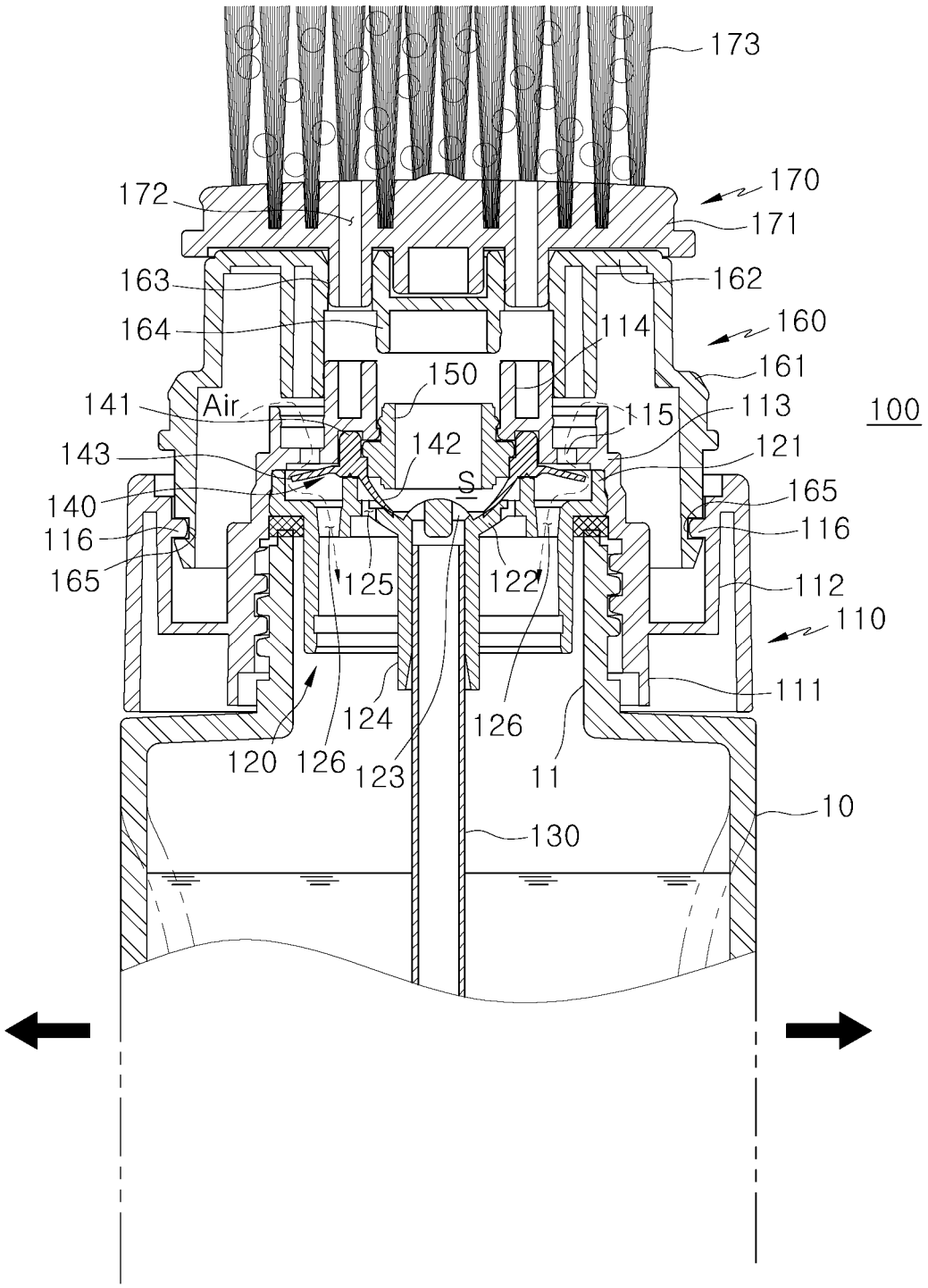
FIG. 7 is a view showing a restoration process (an external air suction process) of the foam generator for compression receptacles according to the present invention.
Figure 8:
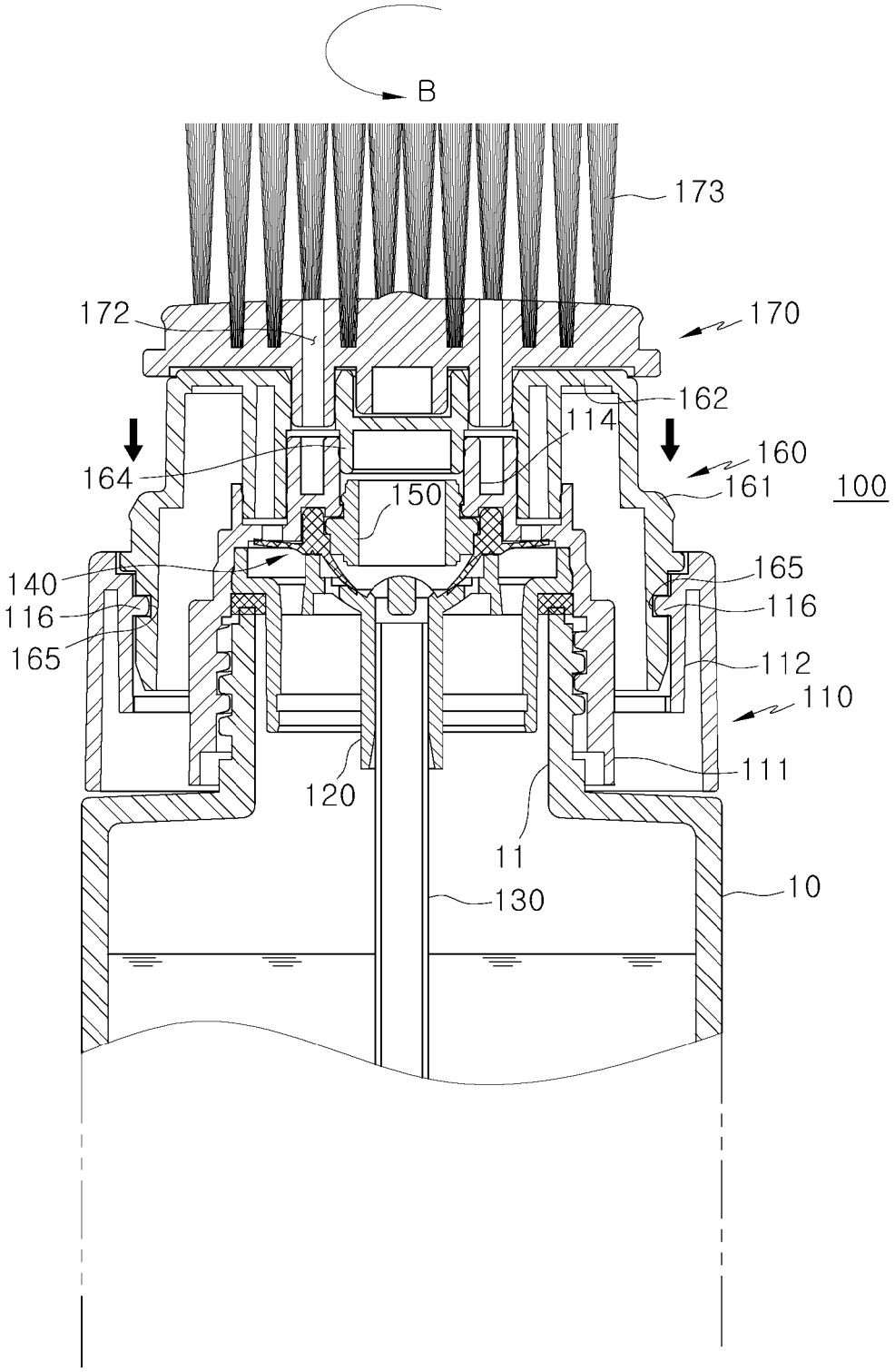
FIG. 8 is a view showing the state in which the foam generator for compression receptacles according to the present invention has been locked using an upward and downward movement cap.

Hereinafter, a preferred embodiment of the present invention will be described in detail with reference to the accompanying drawings. Briefly describing the accompanying drawings, FIGS. 2 to 5 show the structure of a foam generator for compression receptacles according to the present invention, and FIGS. 6 to 8 show the state in which the foam generator for compression receptacles according to the present invention is used.

<Description of Structure of Foam Generator for Compression Receptacles According to the Present Invention>

Figure 2:
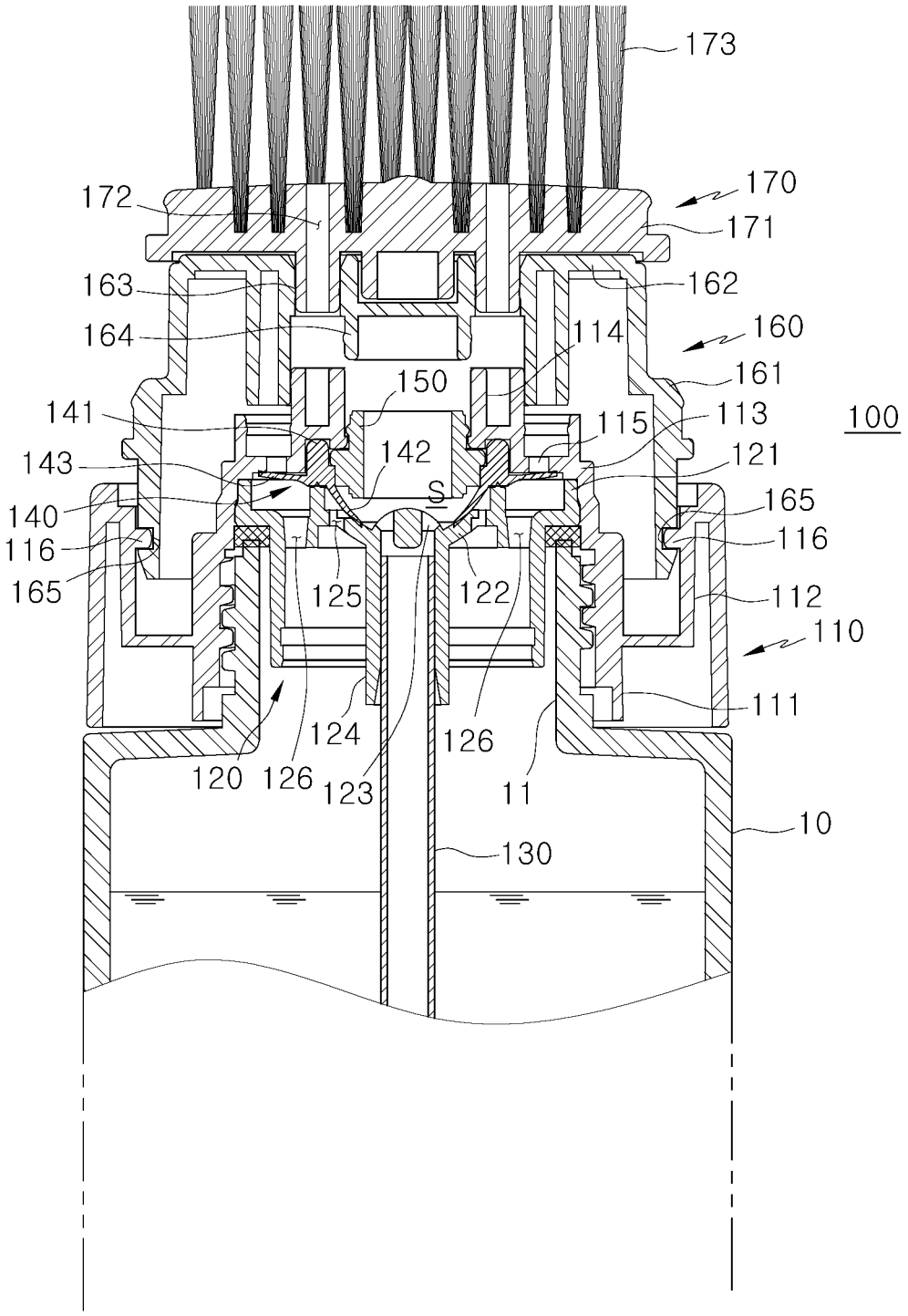
FIG. 2 is a sectional view showing the state in which a foam generator for compression receptacles according to the present invention has been applied to a compression receptacle having contents stored therein.
Figure 3:
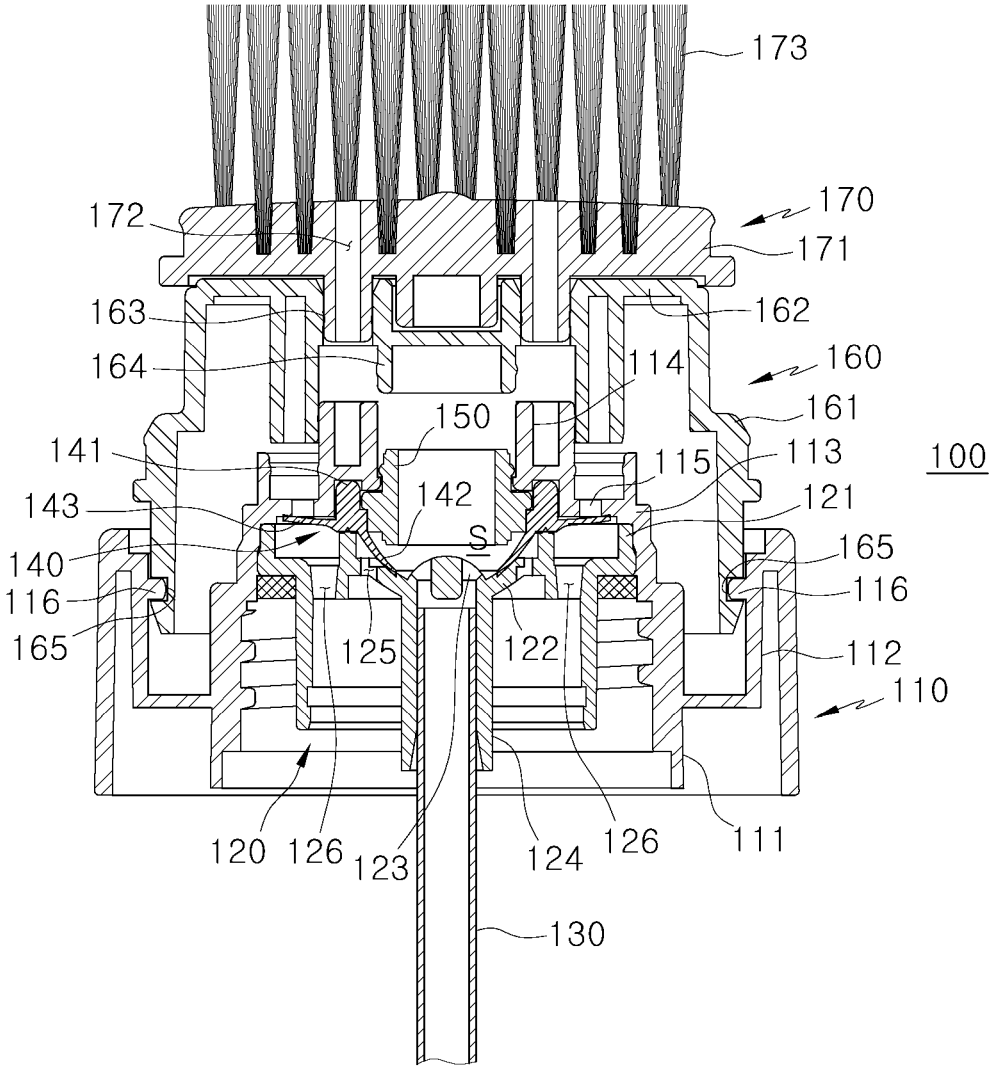
FIG. 3 is a sectional view showing the interior of the foam generator for compression receptacles according to the present invention.

The foam generator for compression receptacles according to the present invention is mounted to a neck of a compression receptacle having contents stored therein such that liquid contents are discharged out of the compression receptacle in the form of foam while the liquid contents are mixed with air using the pressure generated in the compression receptacle when the compression receptacle is directly compressed. As shown in FIGS. 2 and 3, the foam generator for compression receptacles includes a cap main body 110 coupled to a neck 11 of a compression receptacle 10, a content discharge guide 120 received and disposed in the cap main body 110 for guiding the discharge of the liquid contents and air when the compression receptacle 10 is compressed, a check valve unit 140 for controlling the suction and discharge of air according to the compression and restoration operation of the compression receptacle 10, a filtration member 150 received and disposed in the upper end of the cap main body 110 for homogenizing foam formed as the result of the liquid contents being mixed with air, an upward and downward movement cap 160 assembled to the upper end of the cap main body 110 so as to be movable upward and downward for ejecting the foam to the outside, and a massage member 170 mounted to the upper part of the upward and downward movement cap 160. The respective components constituting the foam generator 100 for compression receptacles according to the present invention are made of synthetic resin, which does not chemically react with the liquid contents, and the detailed structures thereof are as follows.

First, the compression receptacle 10 has liquid contents stored therein. The compression receptacle 10 is made of soft synthetic resin, which can be compressed by a user using his/her hand and which can be restored to the original state thereof when the compression force is removed. Screw threads are formed in the outer wall of the neck 11 of the compression receptacle 10.

The cap main body 110 is made of hard synthetic resin. As shown in FIGS. 3 to 5, the cap main body 110 includes a large cap part 111 fastened to the neck 11 of the compression receptacle 10 in a screw coupling manner and a foam discharge part 114 protruding from the upper part of the large cap part 111 in the shape of a pipe having a reduced diameter while a step 113 is formed at the lower end thereof, the upper part of the foam discharge part 114 being open. In addition, an air hole 115 for allowing external air to be introduced therethrough is formed in the step 113 of the cap main body 110. The air hole 115 is configured to allow the external air to be introduced into the compression receptacle 10 therethrough when the compression receptacle 10 is elastically restored to the original state thereof. In addition, an upward and downward movement guide wall 112, which is formed in the shape of a cylinder, is integrally formed at the outside of the large cap part 111. The upward and downward movement guide wall 112 is configured to guide the upward and downward movement of the upward and downward movement cap 160. Support shafts 116 are formed inside the upward and downward movement guide wall 112 in a protruding manner such that the support shafts 116 are opposite each other.

The content discharge guide 120 is also made of hard synthetic resin. As shown in FIGS. 3 to 5, an edge 121 of the content discharge guide 120 is fitted, received, and disposed in the upper end of the large cap part 111 of the cap main body 110 so as to be spaced apart from the lower part of the step 113 of the cap main body 110 by a predetermined distance such that a space is defined therebetween. The content discharge guide 120 includes a discharge guide part 122 having a liquid discharge port 123 formed in the central region thereof so as to be recessed concavely and a tube coupling port 124 provided at the center of the bottom surface of the discharge guide part 122, a discharge tube 130 for discharging the liquid contents stored in the compression receptacle 10 being coupled to the tube coupling port 124. In addition, the discharge guide part 122 is provided at the outside thereof with an air discharge port 125, through which air in the compression receptacle 10 can move to the upper side of the discharge guide part 122 when the compression receptacle 10 is compressed, and with an air introduction port 126, through which external air that has been introduced through the air hole 115 can be introduced into the compression receptacle 10 when the compression receptacle 10 is restored to the original state thereof. In this embodiment of the present invention, six air introduction ports 126 are formed in the outside of the discharge guide part 122 such that the compression receptacle 10 can be instantly restored to the original state thereof, and two air discharge ports 125 are formed so as to be opposite each other, i.e. to be offset at an angle of 180 degrees, such that air can rapidly move to an air and liquid mixing chamber S, a description of which will follow, when the compression receptacle 10 is compressed. In addition, the liquid discharge port 123 of the discharge guide part 122 is formed so as to branch into a plurality of liquid discharge ports at the bottom part of the discharge guide part 122 in the radial direction thereof such that the liquid contents discharged upward through the discharge tube 130 are distributed and smoothly mixed with air in the air and liquid mixing chamber S (in this embodiment of the present invention, the liquid discharge port 123 branches into two liquid discharge ports that are opposite each other, i.e. are offset at an angle of 180 degrees).

The check valve unit 140 is made of an elastic rubber material (silicone or NBR). As shown in FIGS. 3 to 5, the check valve unit 140 includes a ring-shaped partition wall 141, having a lower end disposed in tight contact with the upper surface of the bottom of the content discharge guide 120 and an upper end disposed in tight contact with the lower part of the step 113 of the cap main body 110, for defining the air and liquid mixing chamber S in the foam discharge part 114, a first check valve part 142 disposed inside the partition wall 141 so as to extend downward toward the central part thereof, an end of the first check valve part 142 being disposed in elastically tight contact with the discharge guide part 122 of the content discharge guide 120, the first check valve part 142 being configured to selectively allow the air discharged from the compression receptacle 10 through the air discharge ports 125 to move to the air and liquid mixing chamber S when the compression receptacle 10 is compressed, and a second check valve part 143 disposed outside the partition wall 141 so as to extend upward toward the outside, an end of the second check valve part 143 being disposed in elastically tight contact with the outside of the step 113 of the cap main body 110, the second check valve part 143 being configured to close the air hole 115 when the compression receptacle 10 is compressed and to open the air hole 115 when the compression receptacle 10 is restored to the original state thereof such that air can be introduced through the air hole 115.

As shown in FIGS. 3 to 5, the filtration member 150 includes a cylindrical body 151 fitted, received, and disposed in the foam discharge part 114 (the air and liquid mixing chamber S) of the cap main body 110, the upper and lower parts of the cylindrical body 151 being open, and mesh-shaped filtration nets 152 and 153 provided to cover the upper and lower surfaces of the body 151. Consequently, the filtration member 150 guides the upward discharge of foam formed as the result of the liquid contents being mixed with air in the air and liquid mixing chamber S while homogenizing the foam.

The upward and downward movement cap 160 is configured to guide the discharge of the foam in the foam generator 100 for compression receptacles according to the present invention to the outside and to lock the foam generator 100 for compression receptacles according to the present invention. As shown in FIGS. 3 to 5, the upward and downward movement cap 160 includes a cylindrical wall surface 161 having a lower end received in and coupled to the upward and downward movement guide wall 112 of the cap main body 110 so as to be movable upward and downward and an upper surface 162 configured to cover the upper part of the cap main body 110, the upper surface 162 being provided with a plurality of foam distribution holes 163, through which the foam that has passed through the filtration member 150 is discharged to the outside in a distributed manner. In addition, the upward and downward movement cap 160 is provided at the center of the upper surface 162 thereof with a cylindrical blocking wall 164 for selectively opening and closing the foam discharge part 114 according to the upward and downward manipulation thereof so as to allow or prevent the communication between the foam discharge part 114 and the foam distribution holes 163.

The upward and downward operation of the upward and downward movement cap 160 is achieved by rotating the upward and downward movement cap 160 in the forward direction and the reverse direction. That is, the upward and downward movement cap 160 is provided at the outside of the wall surface 161 thereof with spiral grooves 165 inclined downward from the upper part thereof for receiving the support shafts 116. The spiral grooves 165 are formed so as to be opposite each other in a predetermined region (a 90-degree region in the present invention). Consequently, the upward and downward movement cap 160 is moved upward or downward to the regular positions thereof by rotating the upward and downward movement cap 160 in the forward direction or the reverse direction. When the upward and downward movement cap 160 is moved maximally upward as the result of the rotation of the upward and downward movement cap 160 in the forward direction (in the direction indicated by the arrow A in FIG. 5), therefore, the cylindrical blocking wall 164 becomes spaced apart from the upper part of the foam discharge part 114. As a result, the foam discharge part 114 communicates with the foam distribution holes 163, whereby the foam can be discharged. On the other hand, when the upward and downward movement cap 160 is moved maximally downward as the result of the rotation of the upward and downward movement cap 160 in the reverse direction (in the direction indicated by the arrow B in FIG. 5), the cylindrical blocking wall 164 completely closes the upper part of the foam discharge part 114. As a result, the foam is prevented from being discharged.

Meanwhile, as shown in FIGS. 3 to 5, the massage member 170 includes a base 171 fitted and mounted in the upper part of the upward and downward movement cap 160 so as to cover the upper part of the upward and downward movement cap 160, the base 171 being provided therein with a plurality of communication ports 172, which communicate with the respective foam distribution holes 163, and massage bristles 173 implanted over the entire upper surface of the base 171. The massage bristles 173 are configured to uniformly apply the foam discharged through the communication ports 172 to the skin of a user in the state of being in elastic contact with the skin of the user.

<Description of Operation and Effects of Foam Generator for Compression Receptacles According to the Present Invention>

Next, the operation and effects of the foam generator for compression receptacles according to the present invention will be described with reference to FIGS. 2 and 6 to 8.

First, as shown in FIG. 2, when the foam generator 100 for compression receptacles according to the present invention is in an initial state, the compression receptacle 10 having the liquid contents and the air stored therein is maintained in the original state thereof, the first check valve part 142 of the check valve unit 140 is disposed in tight contact with the discharge guide part 122 of the content discharge guide 120 due to the elastic restoration force thereof, and the second check valve part 143 of the check valve unit 140 is also disposed in tight contact with the outside of the step 113 of the cap main body 110 so as to keep the air hole 115 closed using the elastic restoration force thereof.

When a user presses the compression receptacle 10 in order to compress the compression receptacle 10 (see the direction indicated by the arrow in FIG. 6) in the state in which the upward and downward movement cap 160 has been moved upward, as shown in FIG. 6, pressure is generated in the compression receptacle 10. As a result, the air and the liquid contents in the compression receptacle 10 are compressed. Consequently, some of the liquid contents stored in the compression receptacle 10 move to the air and liquid mixing chamber S through the discharge tube 130 and the liquid discharge ports 123 (see the direction indicated by the solid arrow in FIG. 6). In addition, some of the air in the compression receptacle 10 is compressed so as to close the second check valve part 143 and to open the first check valve part 142, and then moves to the air and liquid mixing chamber S (see the direction indicated by the dashed arrow in FIG. 6).

In the air and liquid mixing chamber S, the compressed air and the liquid contents are mixed with each other to form foam. Since the liquid contents move upward while being distributed through the liquid discharge ports 123, the liquid contents can be more smoothly mixed with the air to instantly form foam. The foam is homogenized while passing through the filtration member 150. The homogenized foam is discharged to the outside via the foam distribution holes 163 in the upward and downward movement cap 160 and the communication ports 172 in the massage member 170.

When the artificial force applied to the compression receptacle 10 is removed, as shown in FIG. 7, the compression receptacle 10 is restored to the original state thereof due to the elastic restoration force thereof, whereby negative pressure is generated in the compression receptacle 10. That is, when negative pressure is generated in the compression receptacle 10 as the result of restoration of the distorted compression receptacle 10 to the original state thereof, the second check valve part 143 of the check valve unit 140 is instantaneously opened. As a result, external air is introduced into the compression receptacle 10. That is, a volume of external air equal to that of the liquid contents that have been discharged from the compression receptacle 10 is introduced into the compression receptacle 10 through the air hole 115 and the air introduction ports 126, whereby the compression receptacle 10 is maintained in the initial state thereof. During the restoration of the compression receptacle 10, the first check valve part 142 of the check valve unit 140 comes into tight contact with the discharge guide part 122 in order to close the air discharge ports 125.

This series of processes may be repeated in order to eject and use the liquid contents stored in the compression receptacle 10 in the form of foam. That is, in the foam generator 100 for compression receptacles according to the present invention, the compression receptacle 10 having the contents stored therein is directly compressed. As a result, the liquid contents are mixed with air due to the pressure in the compression receptacle 10, and the mixture is directly discharged in the form of foam. In addition, even when the user directly compresses the compression receptacle 10 using one hand, the contents are discharged to the outside in the form of foam, thereby improving user convenience. Furthermore, the user can uniformly apply the foam discharged to the outside to his/her skin or can cleanse his/her skin using the massage member 170 without using his/her hands. In particular, the user can uniformly apply the foam to his/her skin while pushing the massage bristles 173 of the massage member 170 onto his/her skin in the manner of massaging the skin of the user.

Meanwhile, when the upward and downward movement cap 160 is rotated by 90 degrees in the reverse direction (in the direction indicted by the arrow B in FIG. 8), as shown in FIG. 8, the upward and downward movement cap 160 is moved downward, whereby the cylindrical blocking wall 164 is received in the foam discharge part 114 while coming into tight contact with the foam discharge part 114 in order to close the foam discharge part 114. {Since the support shafts 116 are received in and coupled to the respective spiral grooves 165, as previously described, the upward and downward movement cap 160 is moved upward and downward only to the regular positions thereof by rotating the upward and downward movement cap 160 in the forward direction and the reverse direction.} In the state in which the upward and downward movement cap 160 has been moved downward to close the foam discharge part 114, as described above, foam can be completely prevented from being discharged even when the compression receptacle 10 is pressed such that the compression receptacle 10 is compressed, whereby the compression receptacle 10 remains locked. That is, the discharge of foam is guided and the compression receptacle 10 is locked through the upward and downward movement cap 160 fastened to the compression receptacle 10 in a rotation and upward and downward movement manner, whereby it is possible to more stably use the product and to prevent the leakage of liquid from the product during the distribution of the product.

INDUSTRIAL APPLICABILITY

The present invention is widely applicable to the field of a foam generator for compression receptacles that mixes liquid contents with air and discharges the mixture in the form of foam when a compression receptacle is directly compressed.

The invention claimed is:

1. A foam generator for a compression receptacle, mounted to a neck of the compression receptacle having liquid contents stored therein for mixing the liquid contents, discharged out of the compression receptacle when the compression receptacle is compressed, with air and discharging the mixed liquid contents in a form of foam, wherein the foam generator comprises:

a cap main body comprising a large cap part fastened to the neck of the compression receptacle in a screw coupling manner, an upward and downward movement guide wall disposed at an outside of the large cap part, the upward and downward movement guide wall being formed in a shape of a cylinder, and a foam discharge part protruding from an upper part of the large cap part in a shape of a pipe having a diameter while a step is formed at a lower end thereof, an upper part of the foam discharge part being open, an air hole for allowing external air to be introduced therethrough being formed in the step;

a content discharge guide configured such that an edge thereof is fitted, received, and disposed in an upper end of the large cap part of the cap main body so as to be spaced apart from a lower part of the step of the cap main body, the content discharge guide comprising a discharge guide part having a liquid discharge port formed in a central region thereof so as to be recessed concavely and a tube coupling port provided at a center of a bottom surface of the discharge guide part, a discharge tube for discharging the liquid contents stored in the compression receptacle being coupled to the tube coupling port, the discharge guide part being provided at an edge thereof with an air discharge port, through which air in the compression receptacle can move to an upper side of the discharge guide part when the compression receptacle is compressed, and with an air introduction port, through which external air is introduced into the compression receptacle when the compression receptacle is restored to an original state thereof;

a check valve unit made of an elastic material, the check valve unit comprising a ring-shaped partition wall, having a lower end disposed in tight contact with an upper surface of the content discharge guide and an upper end disposed in tight contact with the lower part of the step of the cap main body, for defining an air and liquid mixing chamber in the foam discharge part, a first check valve part disposed inside the partition wall so as to extend downward toward a central part thereof, an end of the first check valve part being disposed in elastically tight contact with the discharge guide part of the content discharge guide, the first check valve part being configured to selectively allow the air in the compression receptacle to move to the air and liquid mixing chamber through the air discharge port when the compression receptacle is compressed, and a second check valve part disposed outside the partition wall so as to extend upward toward an outside, an end of the second check valve part being disposed in elastically tight contact with an outside of the step of the cap main body, the second check valve part being configured to close the air hole when the compression receptacle is compressed and to open the air hole when the compression receptacle is restored to the original state thereof such that external air can be introduced;

a filtration member fitted, received, and disposed in the foam discharge part of the cap main body, the filtration member being formed in a shape of a cylinder having open upper and lower parts, the filtration member being provided at upper and lower surfaces thereof with filtration nets, the filtration member being configured to guide a discharge of foam formed as a result of the liquid contents being mixed with air in the air and liquid mixing chamber while homogenizing the foam; and an upward and downward movement cap comprising a cylindrical wall surface having a lower end received in and coupled to the upward and downward movement guide wall of the cap main body so as to be movable upward and downward and an upper surface configured to cover an upper part of the cap main body, the upper surface being provided with a plurality of foam distribution holes, through which the foam that has passed through the filtration member is discharged to the outside in a distributed manner, the upward and downward movement cap being provided at a center of the upper surface thereof with a cylindrical blocking wall for selectively opening and closing the foam discharge part according to an upward and downward manipulation thereof.

2. The foam generator according to claim 1, further comprising a massage member, wherein the massage member comprises:

a base fitted and mounted in an upper part of the upward and downward movement cap, the base being provided therein with a plurality of communication ports, which communicate with the respective foam distribution holes; and massage bristles provided at an upper surface of the base for uniformly applying foam discharged through the communication ports to a skin of a user.

3. The foam generator according to claim 1, wherein support shafts are formed inside the upward and downward movement guide wall in a protruding manner such that the support shafts are opposite each other, and the upward and downward movement cap is provided at an outside of the wall surface thereof with spiral grooves for receiving the support shafts, the spiral grooves being formed so as to be opposite each other over a predetermined region, the upward and downward movement cap being disposed so as to move upward or downward to regular positions thereof by rotating the upward and downward movement cap in a forward direction or a reverse direction, whereby when the upward and downward movement cap is moved maximally upward as a result of the rotation of the upward and downward movement cap in the forward direction, the cylindrical blocking wall opens the foam discharge part, and when the upward and downward movement cap is moved maximally downward as a result of the rotation of the upward and downward movement cap in the reverse direction, the cylindrical blocking wall closes the foam discharge part.

* * * * *